US010921045B2

(12) United States Patent
Clark et al.

(10) Patent No.: US 10,921,045 B2
(45) Date of Patent: Feb. 16, 2021

(54) ROLL-BONDED EVAPORATOR AND METHOD OF FORMING THE EVAPORATOR

(71) Applicant: Whirlpool Corporation, Benton Harbor, MI (US)

(72) Inventors: Taylor Clark, St. Joseph, MI (US); Stephen Keres, Stevensville, MI (US); Il Chung Park, Stillwater, OK (US)

(73) Assignee: Whirlpool Corporation, Benton Harbor, MI (US)

( * ) Notice: Subject to any disclaimer, the term of this patent is extended or adjusted under 35 U.S.C. 154(b) by 142 days.

(21) Appl. No.: 16/256,226

(22) Filed: Jan. 24, 2019

(65) Prior Publication Data

US 2020/0240700 A1 Jul. 30, 2020

(51) Int. Cl.

| | |
|---|---|
| ***F25D 21/08*** | (2006.01) |
| ***F25B 39/02*** | (2006.01) |
| *F25D 11/02* | (2006.01) |

(52) U.S. Cl.

CPC ..... *F25D 21/08* (2013.01); *F25B 39/024* (2013.01); *F25B 2339/022* (2013.01); *F25B 2347/021* (2013.01); *F25D 11/02* (2013.01)

(58) Field of Classification Search

CPC ..... F25B 29/024; F25B 2339/022; F25B 39/024; F25D 21/08

See application file for complete search history.

(56) References Cited

U.S. PATENT DOCUMENTS

| | | | | |
|---|---|---|---|---|
| 2,690,002 A | | 9/1954 | Grenell | |
| 2,701,455 A | * | 2/1955 | Kleist | F25B 47/022 62/278 |
| 2,773,361 A | * | 12/1956 | Jacobs | F25B 39/024 62/444 |
| 2,908,149 A | | 10/1959 | Hall | |
| 2,920,377 A | * | 1/1960 | Janos | F28F 3/12 29/611 |
| 3,195,320 A | | 7/1965 | Kita | |
| 4,344,298 A | | 8/1982 | Biemiller | |
| 4,485,643 A | | 12/1984 | Kato et al. | |
| 4,942,742 A | | 7/1990 | Burruel | |

(Continued)

FOREIGN PATENT DOCUMENTS

| | | | |
|---|---|---|---|
| GB | 509373 | 9/1938 | |
| GB | 854771 | * 11/1960 | F25B 29/024 |

(Continued)

*Primary Examiner* — Cassey D Bauer

(74) *Attorney, Agent, or Firm* — Diederiks & Whitelaw, PLC.

(57) ABSTRACT

A roll-bonded evaporator is formed from a first sheet and a second sheet roll bonded together in face to face relationship with a conductive heater located between the sheets. A refrigerant passageway system is formed in unwelded areas where the first and second sheets are not roll bonded to one another thereby defining a refrigerant channel, a refrigerant inlet and a refrigerant outlet. A heater is preferably formed with a first end and a second end located between the refrigerant inlet and the refrigerant outlet at a proximate end of the evaporator. Alternatively, the conductive heater is formed in a path having the second end located at the distal end of the evaporator and passing through the first sheet at the distal end.

15 Claims, 9 Drawing Sheets

(56) References Cited

U.S. PATENT DOCUMENTS

| | | | |
|---|---|---|---|
| 5,193,357 | A | 3/1993 | Kohl et al. |
| 5,941,091 | A | 8/1999 | Broadbent |
| 6,907,663 | B2 | 6/2005 | Yoon et al. |
| 9,869,504 | B2 | 1/2018 | Park |
| 2011/0302951 | A1 | 12/2011 | Shin et al. |
| 2012/0023993 | A1 | 2/2012 | Palmer et al. |
| 2016/0054047 | A1 | 2/2016 | Lim et al. |
| 2017/0284724 | A1 | 10/2017 | Lee et al. |
| 2018/0066881 | A1 | 3/2018 | Goerz |
| 2018/0106526 | A1 | 4/2018 | Kim et al. |
| 2018/0245826 | A1 | 8/2018 | Jung et al. |

FOREIGN PATENT DOCUMENTS

| | | | | |
|---|---|---|---|---|
| GB | 1213644 | | 11/1970 | |
| GB | 1457871 | | 12/1976 | |
| JP | 57210295 | * | 12/1982 | ..... F25B 39/02 |
| KR | 20180110530 | | 10/2018 | |

* cited by examiner

ROLL-BONDED EVAPORATOR AND METHOD OF FORMING THE EVAPORATOR

BACKGROUND OF THE INVENTION

The present invention pertains to the art of refrigeration and, more particularly, to roll-bonded evaporators for refrigerators. Refrigerators are well known for keeping food cold so that the food may be stored for relatively long periods of time. The basic components of a refrigeration system of a refrigerator include a compressor for compressing refrigerant, a condenser for condensing the compressed refrigerant produced by the compressor and radiating heat from the compressed refrigerant, and an evaporator for cooling air directed over the evaporator. An expansion valve is placed between condenser and the evaporator. As the refrigerant passes through the valve, a flow rate of the refrigerant is increased and a pressure of the refrigerant is reduced. As a result, the refrigerant more easily evaporates in the evaporator thus increasing the amount of cooling provided by the evaporator.

The methods of cooling items in a refrigerator can be classified as indirect cooling or direct cooling. Indirect cooling is achieved by moving air over the evaporator and then over the items to be cooled. Evaporators for refrigerators employing indirect cooling often include fins, or other similar structure, for efficiently cooling air passing adjacent thereto. Such evaporators can be expensive due to the manufacturing process involved and the multiple components of which they are comprised. In addition, such evaporators take up a relatively large amount of space in a refrigerator, which reduces the amount of space available to store food items. One solution to these problems is to use a roll-bonded evaporator, which employs direct cooling, is less expensive and has a lower profile than a traditional finned evaporator. For example, an evaporator can be made by the method disclosed in U.S. Pat. No. 2,690,002, wherein two sheets of metal are bonded together to form an evaporator with coolant passages. However, roll-bonded evaporators, in normal operation, will develop a layer of frost caused by the difference in relative humidity of the air entering the refrigerator and the air near the surface of the evaporator, which causes moisture to condense on the evaporator. The moisture then freezes, creating a layer of frost on the evaporator. The layer of frost interferes with cooling and is considered undesirable. Furthermore, such evaporators are unable to automatically defrost and therefore cannot be used in refrigerators marketed as "frost free," which is a feature consumers consider desirable and prevalent in the premium marketplace.

To address the problem of defrosting, there have been proposals to add an electric heater to a roll-bonded evaporator. For example, there is disclosed, such as in U.S. Pat. No. 3,195,320, a method of adding an electrical heater wire in a heater wire passageway within an evaporator. The heater is arranged to start at one end of the evaporator and to extend to the other end of the evaporator. United States Patent Application Publication No. 2018/0106526 also discloses a roll-bonded evaporator with a heater. In this case, a heater wire simply extends around the outer periphery of the evaporator. Unfortunately, it is considered that, with each of these prior art evaporators, the heater wire does not properly heat the evaporator enough to provide for effective defrost operation.

In view of the above, it would be advantageous to be able to provide a roll-bonded evaporator including a heating wire which, when actuated, is effective in defrosting the roll-bonded evaporator.

SUMMARY OF THE INVENTION

The present invention achieves the above goal by integrating a conductive heater into a roll-bonded evaporator within a refrigerator and, more importantly, specifies a particular arrangement of the heater wire that provides for effective defrosting of the evaporator. Preferably, a refrigerator including a fresh food compartment and a freezer compartment is provided with a refrigeration system configured to cool the fresh food and freezer compartments. The refrigeration system includes an evaporator being formed from a first sheet and a second sheet, roll bonded together in a face to face relationship. The evaporator has a length, a width, a proximal end, a distal end and a conductive heater located between the sheets. A refrigerant passageway system is formed in areas where the first and second sheets are not in contact with one another, thereby defining refrigerant channels, a refrigerant inlet and a refrigerant outlet. Both the inlet and the outlet are preferably located at the proximal end of the evaporator. With this arrangement, the refrigerant pathway system extends from the inlet to the outlet and across a majority of the length and width of the evaporator. The refrigerant pathway system includes numerous structural areas providing different cooling functions, such as serpentine paths that maximize cooling, parallel paths that control refrigerant flow, and pocket areas that store liquid refrigerant and allow the passage of refrigerant in vapor phase. The heater wire is specifically routed in a path with a first end and a second end both located between the refrigerant inlet and the refrigerant outlet at the proximal end of the evaporator and extends across a majority of the length and width of the evaporator. Alternatively, the conductive heater is formed in a path with a second end being at the distal end of the evaporator where the heater passes through the first sheet. Preferably, the conductive heater is planar and the path of the heater runs along the periphery of the cooling areas in the refrigerant pathway system and closely follows the coolant channels near the cooler portions of the pathway system in the evaporator. Preferably, the evaporator is a roll-bonded evaporator that is box shaped and does not include a plurality of fins. The evaporator can be formed into other shapes and be positioned to cool either the freezer compartment, fresh food compartment or both.

The roll-bonded evaporator is preferably formed by placing weld inhibiting material such as graphite and waterglass between the first and second sheet and then roll bonding the first and second sheets to one another by a welding operation to form the refrigerant passageway system of unwelded areas defined by the placement of the weld inhibiting material. The conductive heater may constitute a wire that is inserted into a passageway by applying pulsating high pressure fluid or that is placed between the two sheets of metal before rollbonding. During manufacture, the heater wire is routed in a path with a first end and a second end both located between the refrigerant inlet and the refrigerant outlet at the proximal end of the evaporator. The path extends across a majority of the length and width of the evaporator and runs along the periphery of the cooling areas in the refrigerant pathway system, closely following the coolant channels near the cooler portions of the pathway system.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting but merely as a representative basis for teaching one skilled in the art how to construct and employ the present invention.

Figure 1:
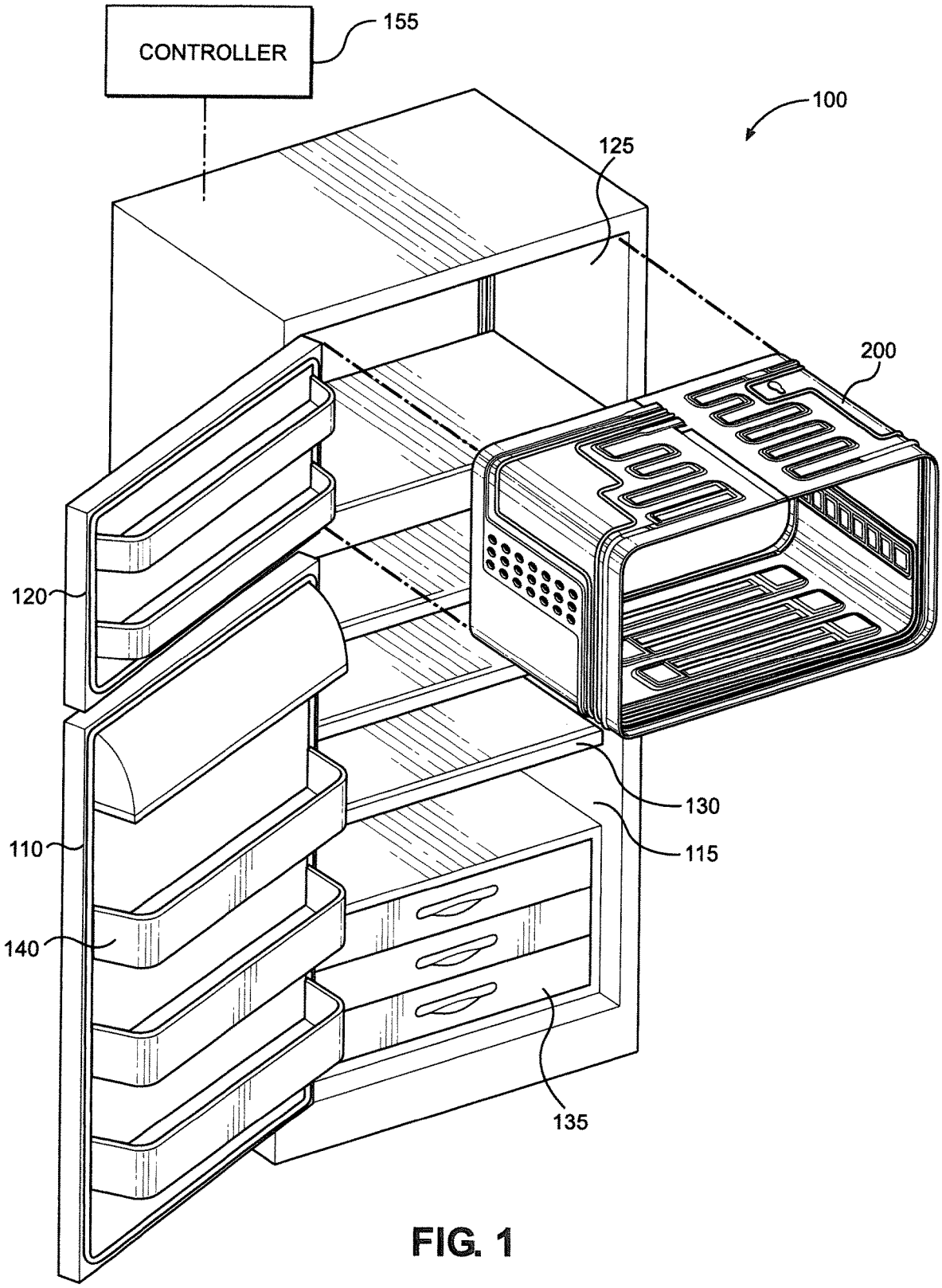
FIG. 1 is a perspective view of a refrigerator constructed in accordance with the present invention.

With initial reference to FIG. 1, there is illustrated a refrigerator 100 constructed in accordance with the present invention. Refrigerator 100 is shown in a top mount configuration, although the present invention can be used with other refrigerator configurations, including French door, bottom mount, single door, multi door and side-by-side configurations. Refrigerator 100 includes a fresh food door 110, which selectively seals a fresh food compartment 115, and a freezer door 120, which selectively seals a freezer compartment 125. For completeness, refrigerator 100 also includes a plurality of shelves (one of which is labeled 130), a plurality of drawers (one of which is labeled 135) and a plurality of door bins (one of which is labeled 140). Refrigerator 100 includes a refrigeration system 150 (represented in FIGS. 2A-2C) that establishes above and below freezing temperatures in compartments 115 and 125, as described in more detail below. A controller 155 controls the operation of refrigerator 100, including operation of the refrigeration system which includes a freezer evaporator 200.

Figure 2A:
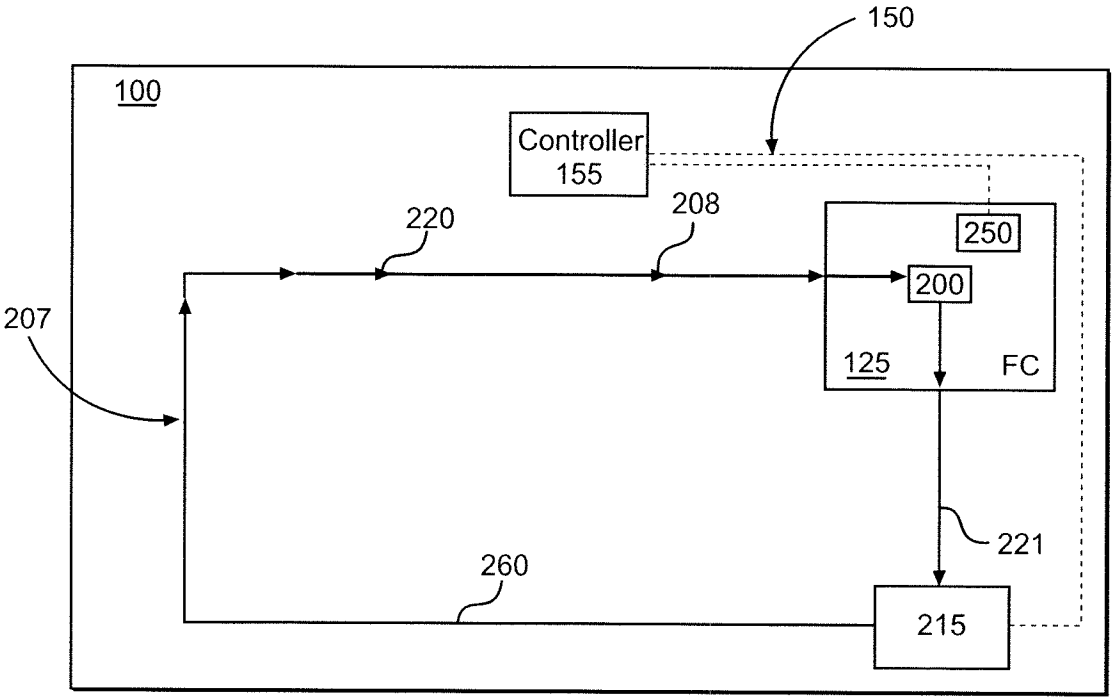
FIG. 2A is a schematic view of a refrigeration system of the refrigerator arranged to directly cool a freezer compartment.
Figure 2B:
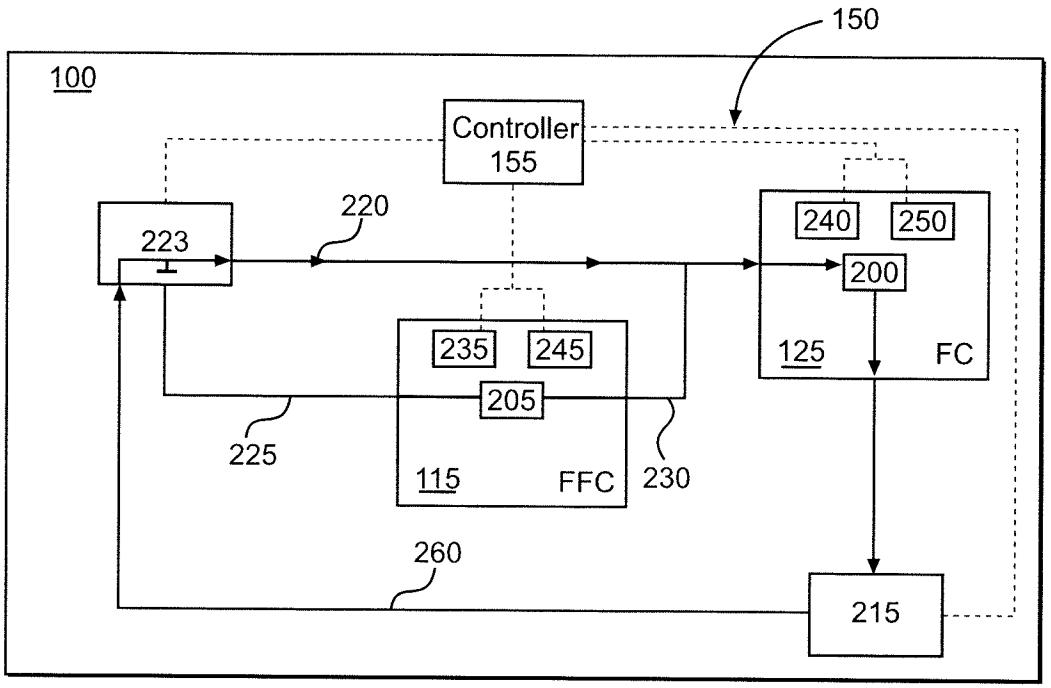
FIG. 2B is a schematic view of a refrigeration system for both a fresh food compartment and a freezer compartment of the refrigerator, with the refrigeration system in a first operational mode.
Figure 2C:
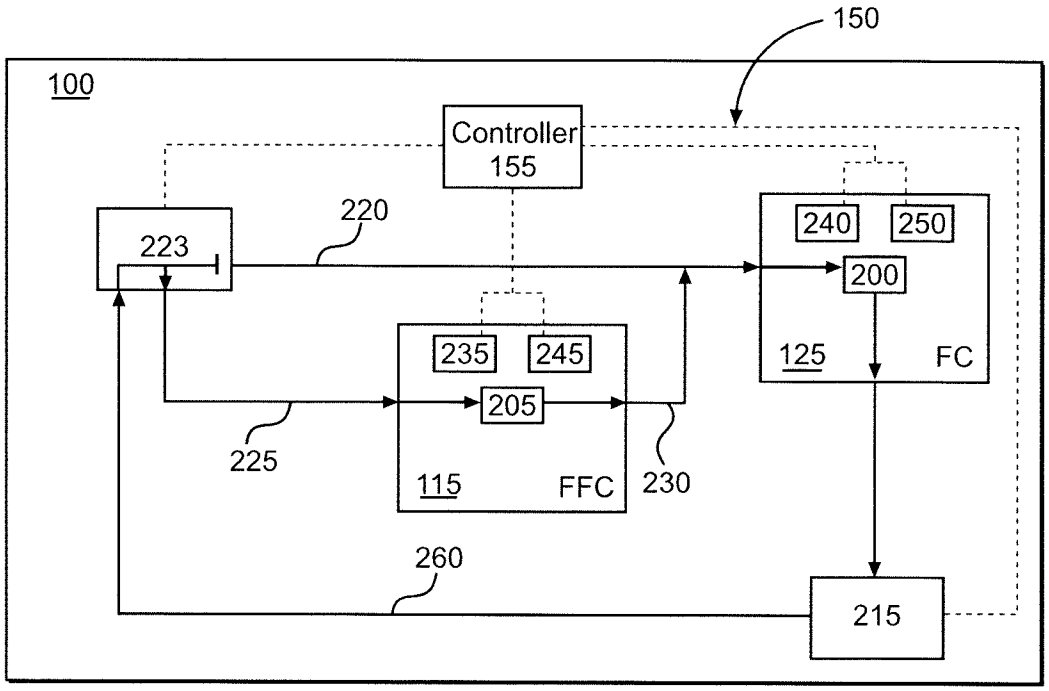
FIG. 2C is a schematic view of the refrigeration system of FIG. 2B, with the refrigeration system in a second operational mode.

Although not of particular importance, for the sake completeness, FIGS. 2A, 2B and 2C show schematic views of refrigerator 100 with portions of an exemplary refrigeration systems also being shown. As discussed above in connection with FIG. 1 and represented in FIGS. 2A, 2B and 2C, refrigerator 100 includes fresh food compartment 115 and freezer compartment 125. In addition, refrigerator 100 preferably includes fresh food evaporator 205 associated with fresh food compartment 115. In a similar manner, freezer evaporator 200 is associated with freezer compartment 125. However, in the embodiment shown in FIG. 2A, refrigerator 100 only shows freezer compartment 125. A refrigeration cycle 207 is shown in FIG. 2A with a flow of refrigerant 208 to evaporator 200 and then to a compressor 215. Refrigerant passes through first line 220 into evaporator 200 and then to a second line 221 leaving evaporator 200. In this embodiment, evaporator 200 is arranged to provide direct cooling of items placed in freezer compartment 125.

FIGS. 2B and 2C show an embodiment with both freezer compartment 125 and fresh food compartment 115 and where cooling is employed. A valve 223 controls the flow of refrigerant from compressor 215 to fresh food evaporator 205 and freezer evaporator 200. In particular, valve 223 has at least two positions. In the first position, as shown in FIG. 2B, refrigerant travels along first line 220 from valve 223 directly to freezer evaporator 200 without passing through fresh food evaporator 205. In the second position, as shown in FIG. 2C, refrigerant travels along a third line 225 from valve 223 to fresh food evaporator 205. Refrigerant then travels from fresh food evaporator 205 to freezer evaporator 200 along a third line 230 and first line 220. As a result, when valve 223 is in the first position, freezer compartment 125 is cooled and, when valve 223 is in the second position, fresh food compartment 115 and freezer compartment 125 are both cooled. Optionally, when indirect cooling is employed, this cooling is accomplished through the use of a fresh food fan 235 and a freezer fan 240, which force air through or past fresh food evaporator 205 and freezer evaporator 200, respectively, in synchronization with the operation of valve 223 (i.e., fresh food fan 235 is operated while refrigerant flows through fresh food evaporator 205 and freezer fan 240 is operated while refrigerant flows through freezer evaporator 200). This chilled air is then circulated through compartments 115 and 125 to cool compartments 115 and 125. In either case a roll bonded evaporator is employed. Preferably when evaporator 200 is employed in freezer compartment 125, evaporator 200 is formed in a box shape as shown in FIGS. 1 and 3C and direct cooling is employed. Evaporator 200 or 205 may be formed in different shapes, as discussed below.

Refrigerator 100 further includes a fresh food temperature sensor 245 and a freezer temperature sensor 250 that measure the temperature of the air in fresh food compartment 115 and freezer compartment 125, respectively. Controller 155 is electrically coupled, either wired or wirelessly, to at least compressor 215, valve 223, fans 235 and 240 and temperature sensors 245 and 250, depending on the configuration of system 150. Controller 155 receives temperature data from temperature sensors 245 and 250 and uses this data to operate compressor 215, valve 223 and fans 235 and 240. Of course, it should be recognized that controller 155 can be electrically coupled to and control other components of refrigerator 100 (e.g., a user interface, lighting, etc.). It should also be recognized that certain components typically included in a refrigeration system for a refrigerator are not shown in FIGS. 2A, 2B and 2C. Such components are usually included in a refrigerator constructed in accordance with the present invention as well but have been omitted for simplicity. These components can include, for example, a condenser, drier and one or more check valves. Typically, the condenser and drier would be provided between compressor 215 and valve 223 (i.e., along a fourth line 260). In addition, although evaporators 200 and 205 and fans 235 and 240 are illustrated as being located within compartments 115 and 125 this need not be the case. Instead, evaporators 200 and 205 and fans 235 and 240 can simply be associated with compartments 115 and 125 such that, in combination with associated ductwork (not shown), evaporators 200 and 205 and fans 235 and 240 are used to supply chilled air to compartments 115 and 125 from a remote location or locations. In any case, the general operation of such refrigeration systems is well known in the art such that certain additional details have been omitted for brevity.

Figure 3A:
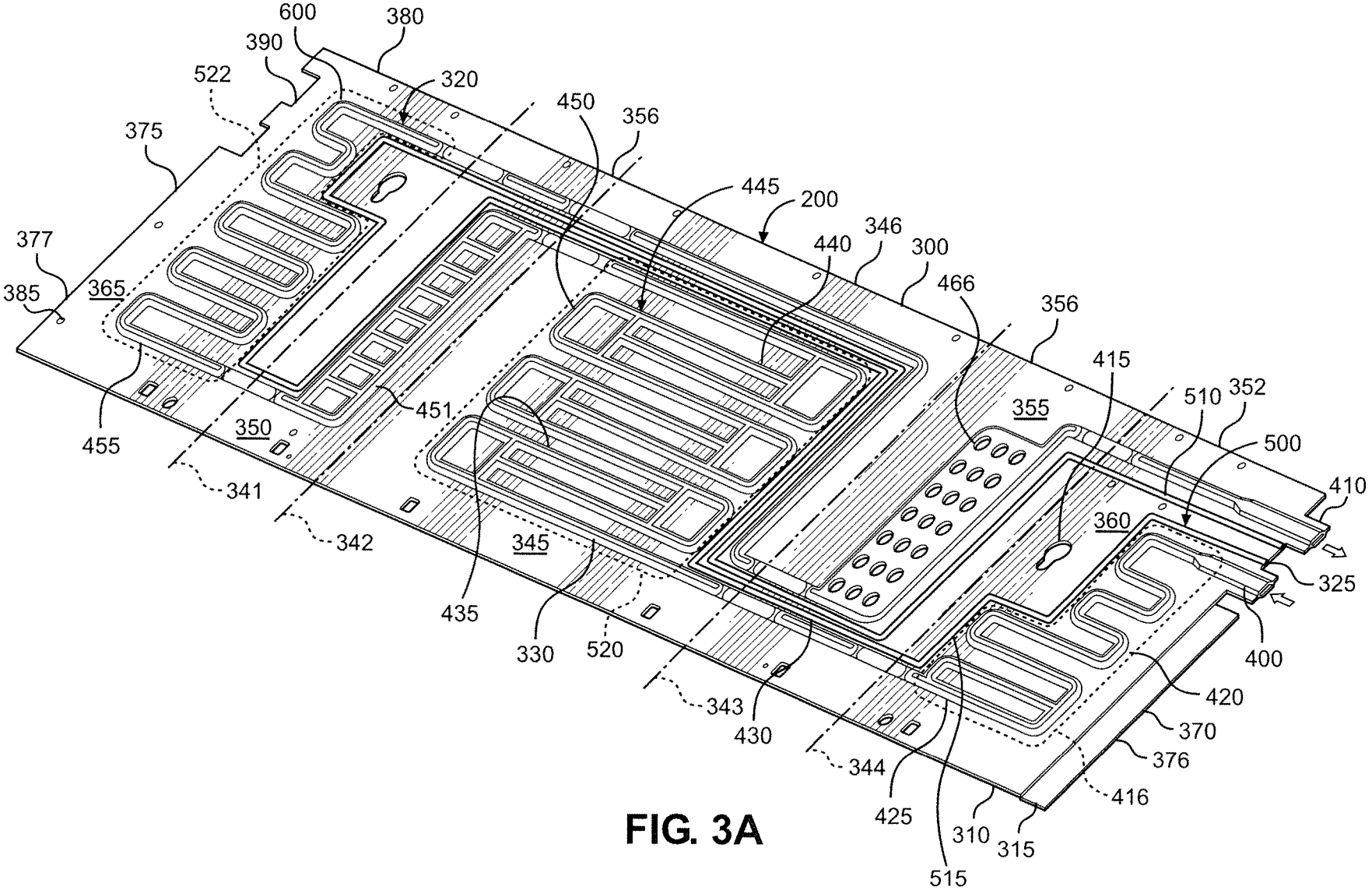
FIG. 3A is a perspective view of an evaporator arranged in a flat configuration according to a first preferred embodiment with both ends of a heater wire being at a proximal end of the evaporator.
Figure 3B:
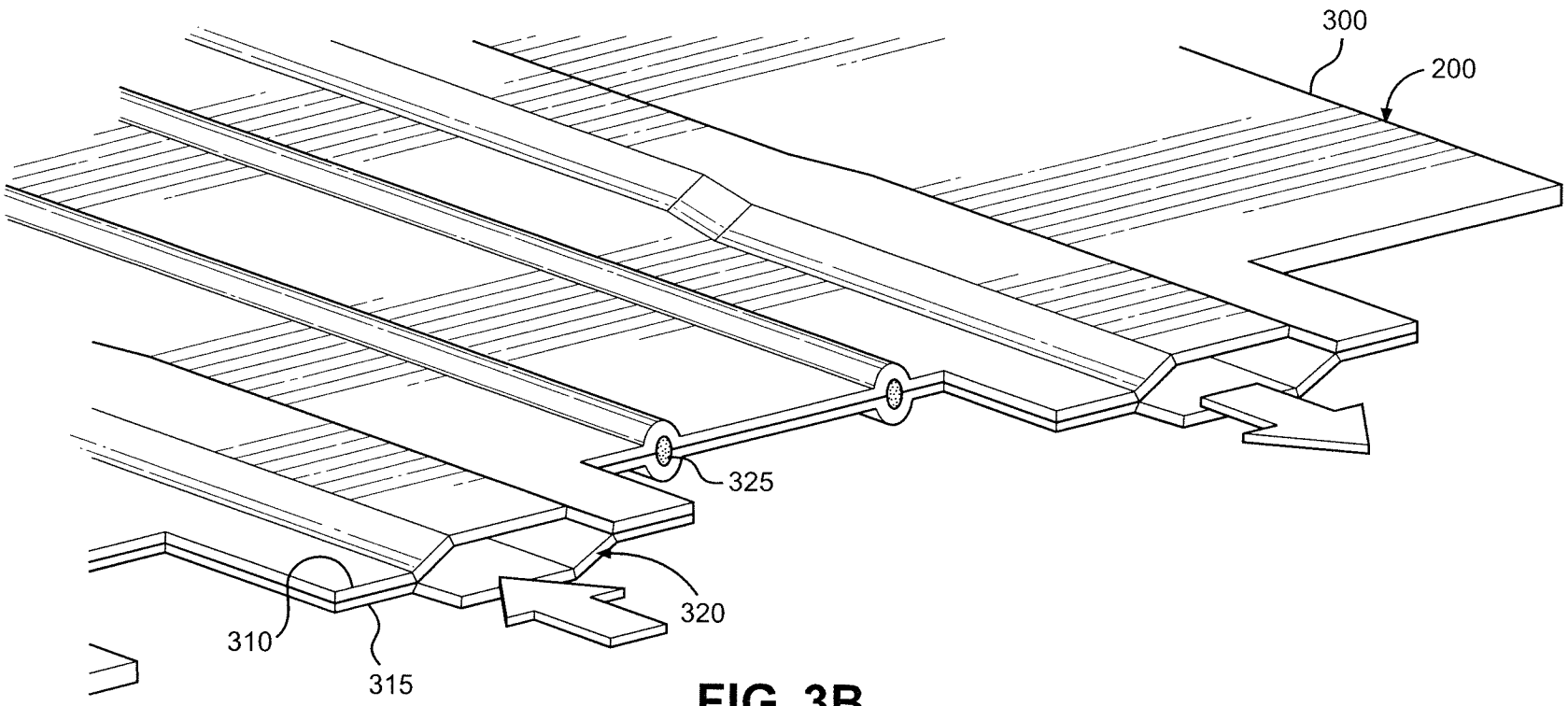
FIG. 3B is a magnified view of the proximal end of the evaporator shown in FIG. 3A.
Figure 3C:
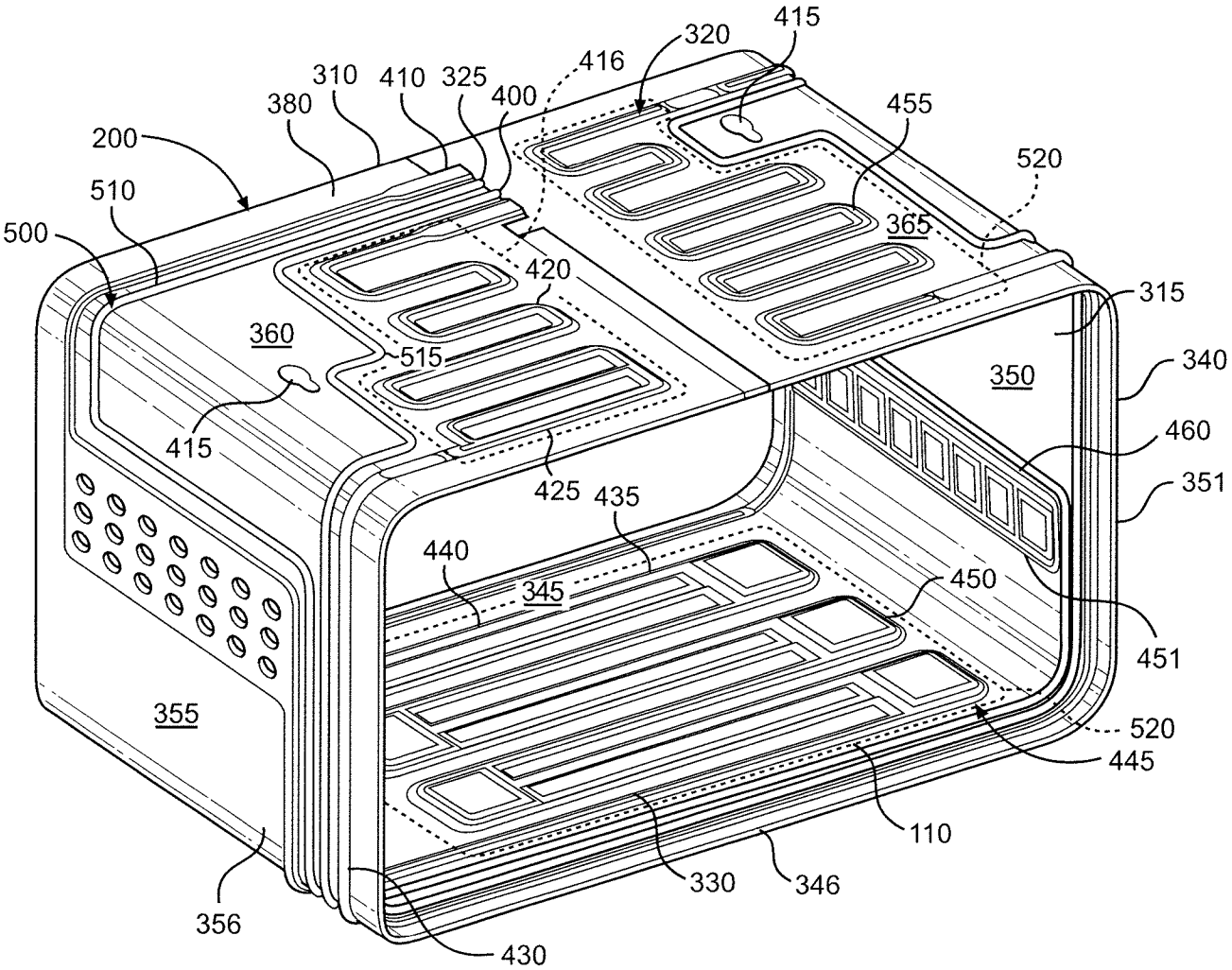
FIG. 3C is a perspective view of the evaporator of FIG. 3A arranged in a box shape.

Of particular importance with respect to the invention is the embodiment shown in FIGS. 3A-3C showing the particulars of evaporator 200. In FIG. 3A there is shown evaporator 200 as a flat panel 300. In some implementations evaporator 200 can be a flat panel 300 or provided in any desired shape formed from initial flat panel 300. Preferably, aluminum is used to form first and second plates 310, 315 which are placed in face to face relation and welded together except where channels 320 have been formed for coolant or channels 325 formed for an electrical heater by a roll bonding method, described in more detail below. A cooling channel pattern 330 formed by coolant channels 320 is specifically designed to produce efficient cooling. Panel 300, as shown in FIG. 3A, is bent to create a freezer compartment that is in a box shape 340, as shown in FIG. 3C. Four dotted lines 341, 342, 343, and 344 are shown on panel 300. An area 345 of panel 300 between dotted lines 342 and 343 constitutes a bottom wall 346 of box shape 340. An area 350, between dotted lines 341 and 342 constitutes a side wall 351 of the box, while an area 355 between dotted lines 343 and 344 constitutes an opposite side wall 356. Areas 360 and 365 formed between a proximate end 370 of panel 300 and dotted line 344 and between a distal end 375 of panel 300 and dotted line 341, respectively, are formed to have overlapping edges 376, 377 so as to be secured together and form a top wall 380 of box shape 340. Overlapping edge 377, at distal end 375, includes holes 385 for fasteners (not shown) that engage with overlapping edge 376. Overlapping edge 377 also includes two cutout holes 390 which line up with an inlet 400 and an outlet 410 of cooling channel pattern 330 to allow inlet 400 and outlet 410 to be connected to line 220 and line 221 of the refrigerant loop shown in FIG. 2A. Mounting holes 415 are provided to mount evaporator 200 in freezer compartment 125 in a known manner.

The refrigerant introduced at inlet 400 passes through a top cooling area 416 with a serpentine cooling path 420 and then to a pair of parallel conduits 425. Cooling area 416 allows cooling refrigerant to spread over a large portion of top wall 380. Path 420 then transits opposite side wall 356 to bottom wall 346 via channel 430. Once in bottom wall 346, path 420 again splits in to a series of parallel passageways 440 forming a pattern 445 designed to maximize heat transfer. While pattern 445 includes loops 450 and parallel conduits 435, a single conduit with a serpentine path could also be employed. Loops 450 and parallel conduits 435 allow for cooling over a large area of bottom wall 346 and also allow for refrigerant to pool in some areas while vaporize coolant proceeds further along path 420. Also pattern 445 can be altered for different types of refrigerators to adjust the flow of coolant through evaporator 200. Coolant path 420 then enters side wall 351 where coolant path 420 is generally formed in a ladder 451. The ladder shape again is designed to spread the coolant over a wide area but also allows for some accumulation of the coolant. Path 420 then travels across top wall 380 in another serpentine path 455. Next coolant path 420 travels straight along bottom wall 346 and then to side wall 356 where coolant path 420 opens up into an accumulator pocket 466 before exiting evaporator 200 at outlet 410. Accumulator pocket 466 covers a substantial area and therefore has a substantial volume for holding refrigerant that may still be in liquid phase. The various shapes of coolant path 420 with accumulator pockets or areas are by design. In operation, the liquid refrigerant may not completely evaporate as the refrigerant passes though loops 450 or parallel conduits 435 or other sections of path 420. The shape of the conduits allows for evaporated refrigerant to proceed to outlet 410 while liquid refrigerant may be trapped in some of the pockets, such as pocket 466. Evaporation of the refrigerant located in pocket 466 aids in cooling evaporator 200. The placement of pockets 466 and positioning of conduit path 420 can vary the cooling capacity of various areas of evaporator 200. For example, conduit path 420 can be designed to cool evaporator 200 more in areas closer to door 120. Also conduit path 420 is designed to have mostly vaporized refrigerant exit through outlet 410.

A path 500 of a heater wire 510 is best seen in FIG. 3A. Important in connection with the invention, heater wire 510 has a first end between refrigerant inlet 400 and refrigerant outlet 410, then closely follows an outer edge 515 of cooling area 416. Heater wire 510 then follows coolant path 420 from top wall 352 across side wall 356 and around a perimeter 520 of parallel passageways 440 of bottom wall 346. Next heater wire 510 transits opposite side wall 356 while following ladder 451 and then passes back to top wall 380 to follow a perimeter 522 of serpentine path 455 of coolant path 420. Heater wire 510 follows path 420 back along bottom wall 346, particularly keeping a close distance to path 420 all the way to accumulator pockets 466. Heater wire 510 then follows coolant path 420 to outlet 410.

Overall, heater wire 510 is positioned to heat evaporator 200 along coolant path 420 to defrost evaporator 200 when electric current is passed through heater wire 510. Heater wire 510 is particularly effective due to the positioning of heater wire 510 along cooling path 420 between inlet 400 and distal end 375 where cooling path 420 is coldest and also the starting of heater wire 510 between inlet 400 and outlet 410 which has the advantage of the first and the second ends of heater wire 510 being near each other.

Figure 4A:
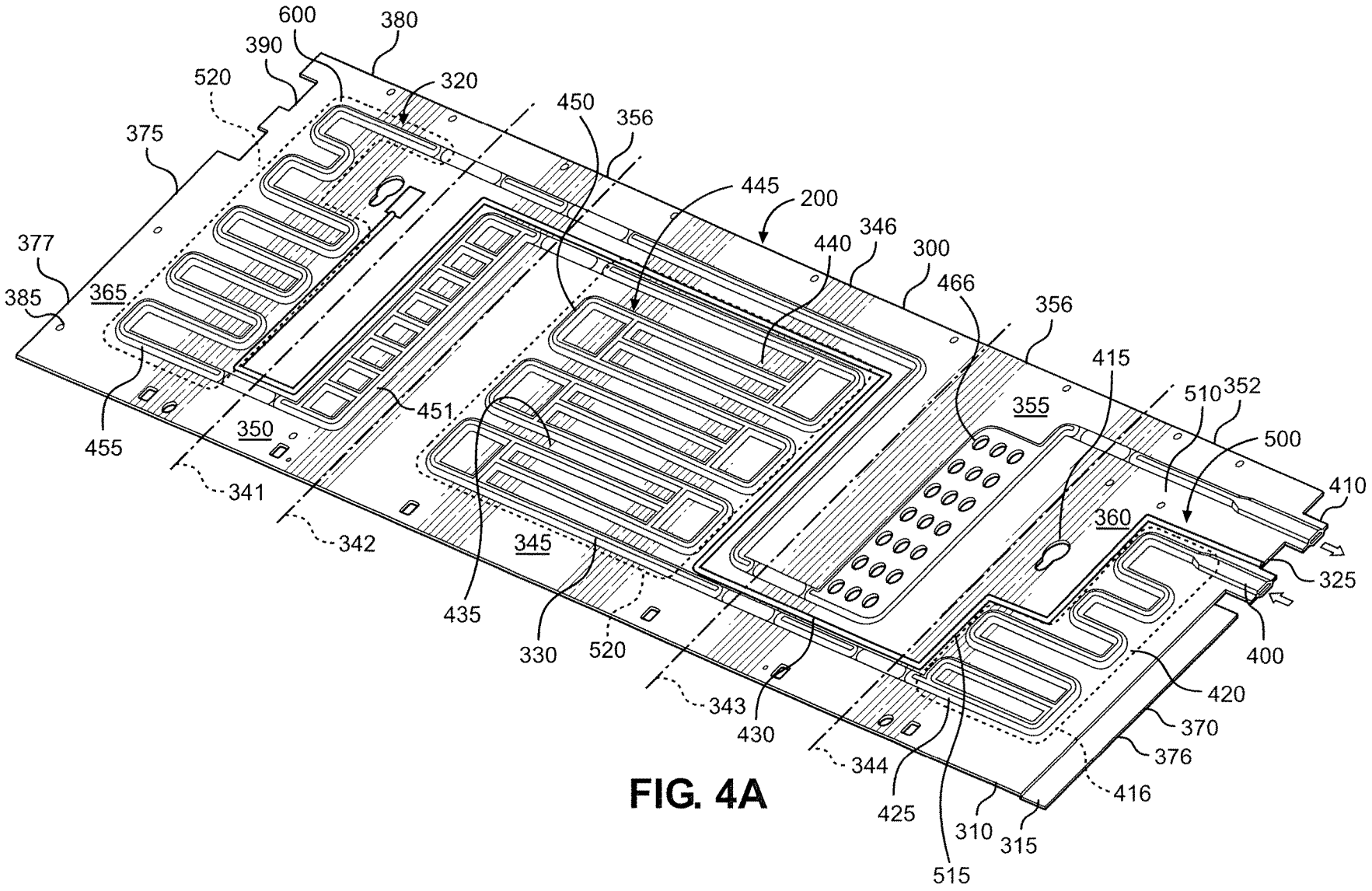
FIG. 4A is a perspective view of an evaporator according to a second preferred embodiment with one end of a heater wire being at a proximal end of the evaporator and another end of the heater wire being at a distal end.
Figure 4B:
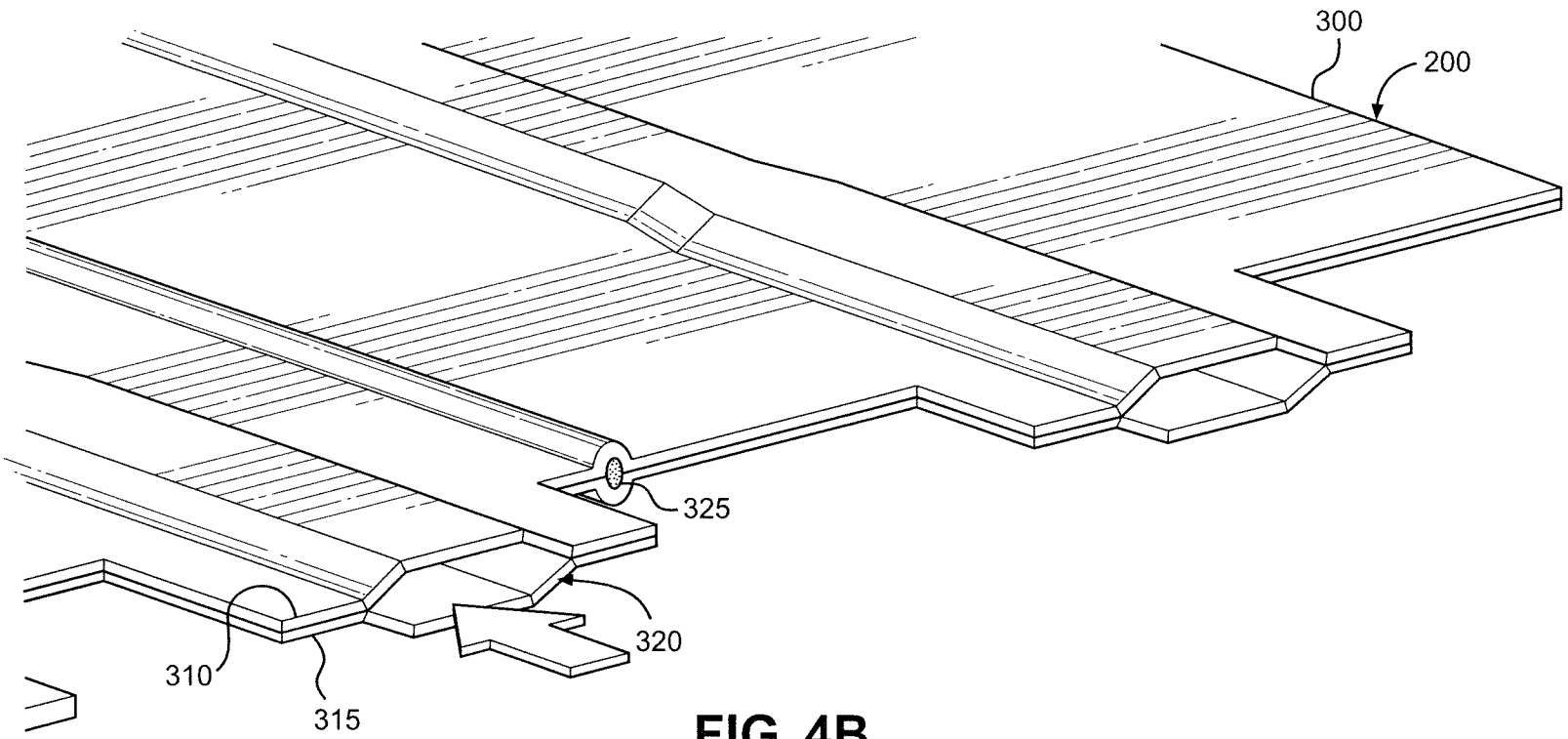
FIG. 4B is a magnified view of the proximal end of the evaporator shown in FIG. 4A.

In a second embodiment shown in FIG. 4A, heater wire 510 follows the same path as shown in FIG. 3A until heater wire 510 passes ladder 451. At that point heater wire 510 passes through one of the two metal plates 310, 320 and exits evaporator 200. Once again heater wire 510 passes near the coolest parts of evaporator 200 and the beginning and ends of heater wire 510 are near each other in top wall 352.

For the sake of completeness, an exemplary method of forming evaporator 200 is being presented. To form evaporator 200, two metal plates 310, 315 are degreased in a bath organic solvent such as naphtha or white gasoline and then cleaned in an acid bath in order to remove any oxide film on the metal sheets. The sheets are then rinsed with water and dried so as to have clean surfaces needed to achieve good bonding in the hot rolling operations discussed below. A weld preventing or separation material such as a mixture of graphite in sodium oxide and silica (waterglass) is applied to selected areas on the face of one of the sheets of metal. The material may be sprayed or painted or applied in any suitable manner to form pattern 330 that will determine where the cooling channels run through evaporator 200. The material extends to the edge of each sheet to provide inlet 400 and outlet 410 for the cooling channels. Pattern 330 should account for elongation of the metal sheets during rolling. After the material has been applied, plates 310, 315 are placed together with the material between plates 310, 315 and then fastened to prevent relative movement and to form an assembly. The assembly is then heated in an oven and pressure welded in a rolling operation. The temperatures and pressures applied to the assembly are dependent on the particular metal used in the sheets. Preferably the assembly is hot rolled in one pass and then cleaned again to remove any oxide film. The assembly is then cold rolled to obtain a desired thickness of the assembly. The assembly is then attached to a pressure source at inlet 400 and hydraulic fluid is sent into the assembly to produce cooling path 420 by expanding the metal of the sheets along the pattern formed by the material. The assembly may then be formed into a box shape. Of course the assembly can also be formed in to the box shape before the hydraulic pressure is applied. The roll bonding method is known in the art and more details are described in U.S. Pat. No. 2,690,002, incorporated herein by reference.

In accordance with the invention, heater wire 510 passes through evaporator 200 through heating channel 325 formed in evaporator 200 in a manner similar to the cooling channels as described above. Once channel 325 is formed, wire 510 is inserted through heating channel 325. Preferably, heating wire 510 is flexible and is formed of a Nichrome wire wrapped around a glass core and covered with a silicon rubber. When wire 510 is being inserted, a pulsating current of high pressure air may be applied to assist with insertion of the wire as described in U.S. Pat. No. 3,195,320, incorporated herein by reference. Alternatively, the heating wire may be placed between the two metal sheets before the roll bonding operation. In such a case, the wire must be made of a material than withstand the high temperatures and high pressures involved with the roll bonding step.

Based on the above, it should be readily apparent that the present invention provides a roll-bonded evaporator that can automatically defrost, with a heater wire that is strategically routed to enhance defrost operation. That is, the wire closely follows the cooler areas of the refrigerant channels including portions of the channels near the channel inlet and portions of the channels designed to evaporate larger amounts of refrigerant. For example, the wire is positioned near parallel paths of refrigerant and paths of refrigerant formed in pockets or loops. While certain preferred embodiments of the present invention have been set forth, it should be understood that various changes or modifications could be made without departing from the spirit of the present invention. For instance, although described in connection with refrigerator 100, it should be recognized that evaporator 200 of the present invention is not limited to use in refrigerators. For example, evaporator 200 can be used in air-conditioning units that need periodic defrosting or any cooling device employing an evaporator. In general, the invention is only intended to be limited by the scope of the following claims.

The invention claimed is:

1. A refrigerator comprising:

a freezer compartment;

a freezer door configured to selectively seal the freezer compartment;

a refrigeration system configured to chill the freezer compartment, the refrigeration system including:

a roll-bonded evaporator being formed from a first sheet and a second sheet roll bonded together in face to face relationship and having a length, a width, a proximal end and a distal end, a conductive heater located between the sheets, and a refrigerant passageway system including a refrigerant channel, a refrigerant inlet and a refrigerant outlet, with the refrigerant channel being formed in a path extending from the inlet to the outlet and across a majority of the length and width of the evaporator and having at least one portion formed in a serpentine shape, the conductive heater being formed in a path with a first end located between the refrigerant inlet and the refrigerant outlet at the proximal end and wherein the conductive heater passes through the first sheet at the distal end.

2. The refrigerator of claim 1, wherein the conductive heater is located within a channel defined between the first and second sheets.

3. The refrigerator of claim 1, wherein the conductive heater is formed with a second end located at the distal end.

4. The refrigerator of claim 1, wherein the conductive heater is planar.

5. The refrigerator of claim 1, wherein the roll-bonded evaporator is box shaped.

6. The refrigerator of claim 1, wherein the path formed by the refrigerant channel includes a loop pattern and a ladder pattern and the conductive heater closely follows the loop pattern and the ladder pattern.

7. A roll-bonded evaporator comprising:

a first sheet and a second sheet roll bonded together in face to face relationship and having a length, a width, a proximal end and a distal end, a conductive heater located between the sheets, and a refrigerant passageway system including a refrigerant channel, a refrigerant inlet and a refrigerant outlet, with the refrigerant channel being formed in a path extending from the inlet to the outlet and across a majority of the length and width of the evaporator and having at least one portion formed in a serpentine shape, the conductive heater being formed in a path with a first end located between the refrigerant inlet and the refrigerant outlet at the proximal end and wherein the conductive heater passes through the first sheet at the distal end.

8. The roll-bonded evaporator of claim 7, wherein the conductive heater is located within a channel defined between the first and second sheets.

9. The roll-bonded evaporator of claim 7, wherein the conductive heater is formed with a second end located at the distal end.

10. The roll-bonded evaporator of claim 7, wherein the conductive heater is planar.

11. The roll-bonded evaporator of claim 7, wherein the roll-bonded evaporator is box shaped.

12. The roll-bonded evaporator of claim 7, wherein the path formed by the refrigerant channel includes a loop pattern and a ladder pattern and the conductive heater closely follows the loop pattern and the ladder pattern.

13. A method of forming a roll-bonded evaporator, the method comprising:

placing weld inhibiting material between a first sheet and a second sheet;

roll bonding the first and second sheets to one another by a welding operation to form a refrigerant passageway system of unwelded areas defining a refrigerant channel, a refrigerant inlet and a refrigerant outlet, with the refrigerant channel being formed in a path extending from the refrigerant inlet to a refrigerant outlet;

creating a heater path;

adding a heater in the path with a first end of the heater located between the refrigerant inlet and the refrigerant outlet at a proximal end of the evaporator; and forming the heater so that the heater passes through the first sheet at the distal end.

14. The method of forming a roll-bonded evaporator of claim 13, further comprising forming the heater with a second end located at a distal end of the evaporator.

15. The method of claim 13, further comprising forming the heater to closely follow a loop pattern and a ladder pattern included in the path formed by the refrigerant channel.

* * * * *